US010494869B2

(12) United States Patent
Comacchio et al.

(10) Patent No.: US 10,494,869 B2
(45) Date of Patent: Dec. 3, 2019

(54) DRILLING MACHINE

(71) Applicant: Comacchio Srl, Riese Pio X (IT)

(72) Inventors: Pasqualino Comacchio, Riese Pio X (IT); Renzo Comacchio, Riese Pio X (IT); Patrizio Comacchio, Riese Pio X (IT)

( * ) Notice: Subject to any disclaimer, the term of this patent is extended or adjusted under 35 U.S.C. 154(b) by 265 days.

(21) Appl. No.: 15/519,327

(22) PCT Filed: Oct. 22, 2015

(86) PCT No.: PCT/IB2015/058153
§ 371 (c)(1),
(2) Date: Apr. 14, 2017

(87) PCT Pub. No.: WO2016/063243
PCT Pub. Date: Apr. 28, 2016

(65) Prior Publication Data
US 2017/0241205 A1 Aug. 24, 2017

(30) Foreign Application Priority Data
Oct. 24, 2014 (IT) ..... PD2014A0278

(51) Int. Cl.
*E21B 19/24* (2006.01)
*E21B 7/02* (2006.01)
*E21D 20/00* (2006.01)

(52) U.S. Cl.
CPC ..... *E21B 7/025* (2013.01); *E21B 7/024* (2013.01); *E21B 7/027* (2013.01); *E21B 19/24* (2013.01); *E21D 20/003* (2013.01)

(58) Field of Classification Search
CPC ..... E21B 7/025; E21B 17/024; E21B 17/027; E21B 19/24; E21D 20/003
USPC ..... 173/184
See application file for complete search history.

(56) References Cited

U.S. PATENT DOCUMENTS

| | | | | |
|---|---|---|---|---|
| 8,317,430 | B2 * | 11/2012 | Yan | E21D 20/00 173/185 |
| 2004/0178004 | A1 * | 9/2004 | MacDonald | E21B 7/024 175/162 |
| 2005/0029796 | A1 | 2/2005 | Barthomeuf | |

FOREIGN PATENT DOCUMENTS

| | | |
|---|---|---|
| DE | 10346583 | 5/2005 |
| EP | 0424779 | 5/1991 |
| JP | 2000104490 | 4/2000 |
| WO | 2011044877 | 4/2011 |
| WO | 2012098492 | 7/2012 |

* cited by examiner

*Primary Examiner* — Michelle Lopez
(74) *Attorney, Agent, or Firm* — Themis Law

(57) ABSTRACT

A drilling machine includes a self-propelled motor vehicle, a front drilling member, and a rear drilling member, wherein at least one of the front or rear drilling members has at least one drilling head suited to be oriented in any direction with respect to the advance direction of the machine, and wherein at least one of the front or rear drilling members has an integrated sliding system suited to stabilize the member on the ground.

7 Claims, 5 Drawing Sheets

DRILLING MACHINE

The present patent concerns drilling and roof bolting machines, and in particular it concerns a new compact drilling machine offering improved performance.

Drilling and roof bolting machines are known, which are suited to be used for underground operations, in tunnels or mines.

Self-propelled drilling machines are known, meaning drilling machines that comprise a vehicle on which the operating members are mounted.

Drilling machines are known, which comprise vehicles provided with a rigid or articulated frame, with tracks, oscillating or non-oscillating, and a front portion suited to support one or two drilling members, whose start position is typically horizontal and parallel to the direction of advance of the machine.

A drawback posed by the drilling machines of the known type lies in that they are relatively bulky, especially as regards their height, thus being unable to be effectively used in spaces with reduced width and especially with reduced height, for example underground or inside mine tunnels.

In such cases, said drilling machines are mainly used maintaining the drilling members in horizontal position and parallel to the advance direction, and operating said drilling members orthogonally to the surface to be drilled that is in front of the machine.

Furthermore, inside tunnels the ground is often quite uneven and drilling machines need to be provided with special devices intended to stabilize the machine on the ground during the drilling operations.

Document US2005/0029796 concerns a vehicle for drilling and roof bolting machines, which comprises a rigid frame mounted on a tracked undercarriage, and wherein the operating members, in particular the drilling or roof bolting tools, are mounted on the front and on the back of said frame.

Said vehicle comprises, in particular, a front drilling arm and a rear drilling arm, wherein the rest position of said arms is horizontal and orthogonal to the advance direction of the machine.

Each one of said arms comprises means for positioning the drilling members, which lift or lower the drilling members with respect to the ground while at the same time maintaining the drilling direction unchanged. Therefore, a machine of the type described above allows drilling and roof bolting operations to be carried out in all directions, at various heights.

In this way, the machine is substantially positioned beside the drilling surface.

A drawback posed by the machines of the known type lies in that they can perform neither drilling operations in generally inclined directions nor drilling operations in generally vertical directions, which instead are necessary especially for roof bolting and for consolidating the walls of tunnels.

In order to overcome said drawbacks, a new type of compact drilling machine with improved performance has been designed and constructed.

The main object of the present invention is to provide a machine that can carry out drilling operations in all directions, especially underground, in tunnels or mines.

It is another object of the invention to guarantee optimal manoeuvrability of the machine.

It is a further object of the present invention to maximize the distance of at least one drilling head from the ceiling of the tunnel, in such a way as to allow drilling operations to be performed even in places with extremely reduced height.

It is another object of the present invention to maximize the distance of the drilling head from the ceiling of the tunnel so as to maximize also the length of the rods to be loaded and thus reduce the total number of rods used during the drilling operations.

Consequently, the time required for loading and even for collecting the drilling rods is reduced.

It is another object of the present invention to provide a machine that can be stabilized, especially during vertical drilling operations, meaning operations where the drilling direction is substantially orthogonal to the surface on which the machine rests.

These and other direct and complementary objects are achieved by the new type of drilling machine comprising, in its main parts, the following components:

- a self-propelled motor vehicle;
- at least one front drilling member, meaning a drilling member mounted on the front portion of the vehicle with respect to its advance direction;
- at least one rear drilling member mounted on the rear portion of the vehicle with respect to its advance direction, and wherein at least one of said drilling members, the front one and/or the rear one, comprises at least one drilling head that can be oriented in any direction with respect to the direction of advance of the machine, and wherein at least one of said drilling members, the front one and/or the rear one, comprises means for stabilizing it on the ground, integrated in the member itself.

Said stabilization means are particularly useful for performing drilling operations in the ceiling of tunnels.

In the preferred embodiment of the invention, said front drilling member in turn comprises:

- at least one drilling head translating on a corresponding guide;
- said guide of the drilling head, directly or indirectly constrained to at least one arm;
- said arm, directly or indirectly constrained to said vehicle;
- means suited to constrain said arm to said vehicle and to allow the rotation of said arm around two axes that are orthogonal to each other;
- means suited to constrain said guide of the drilling head to said arm and suited to allow the rotation of said guide around two axes that are orthogonal to each other.

In greater detail, said arm is constrained to said frame through a first bearing ring with horizontal axis and through at least one first hinge with axis parallel to that of said bearing ring, said arm being furthermore constrained to said guide through at least one second hinge with axis parallel to the axis of said first hinge and through at least one second bearing ring with axis orthogonal to that of said second hinge.

In the rest position, said guide of the head of the front drilling member is arranged horizontally, parallel or orthogonal to the direction of advance of the machine.

In the operating position, said drilling head of the front member can however be rotated, for example it can be arranged on a plane that is orthogonal to the direction of advance and oriented according to a horizontal or inclined direction, in order to perform at least horizontal or inclined drilling operations on a drilling surface that is located beside the machine.

Said drilling head of the front member can also be rotated on the horizontal plane and oriented so that it is parallel or inclined with respect to the direction of advance, in order to perform horizontal or inclined drilling operations on a drilling surface that is located in front of the machine.

In the preferred embodiment of the invention, said rear drilling member in turn comprises:

- at least one drilling head translating on a corresponding guide;
- said guide of the drilling head, directly or indirectly constrained to at least one arm;
- said arm, directly or indirectly constrained to said vehicle through constraining means suited to vary the inclination of said arm with respect to the frame of the machine both horizontally and vertically, so that said guide of the drilling head can be translated on both the horizontal and the vertical plane.

Said guide of the drilling head of the rear member is preferably maintained in a substantially vertical position, both in the rest position and in the operating position.

Said constraining means of said arm make it possible to translate said guide vertically until placing it in contact with the ground, that is, at the maximum distance from the drilling surface on the ceiling of the tunnel.

For this purpose, said guide comprises hydraulic or pneumatic means suited to translate a portion or foot of said guide towards the ground, until placing it in contact with the ground itself, consequently lowering the drilling head to the minimum distance from the ground and thus stabilizing the rear drilling member during the perforation of the ceiling of the tunnel or of the excavation site in general.

According to the invention, said rear drilling member can comprise also at least one bearing ring suited to rotate said guide with respect to a horizontal axis, thus varying the inclination of the guide itself, and consequently of the drilling direction, on a vertical plane.

The new machine is also provided with control components suited to control the motion of the vehicle and with control components suited to control said front and rear drilling members.

The characteristics of the new machine are highlighted in greater detail in the following description, with reference to the attached drawings that are enclosed hereto by way of non-limiting example.

Figure 5A:
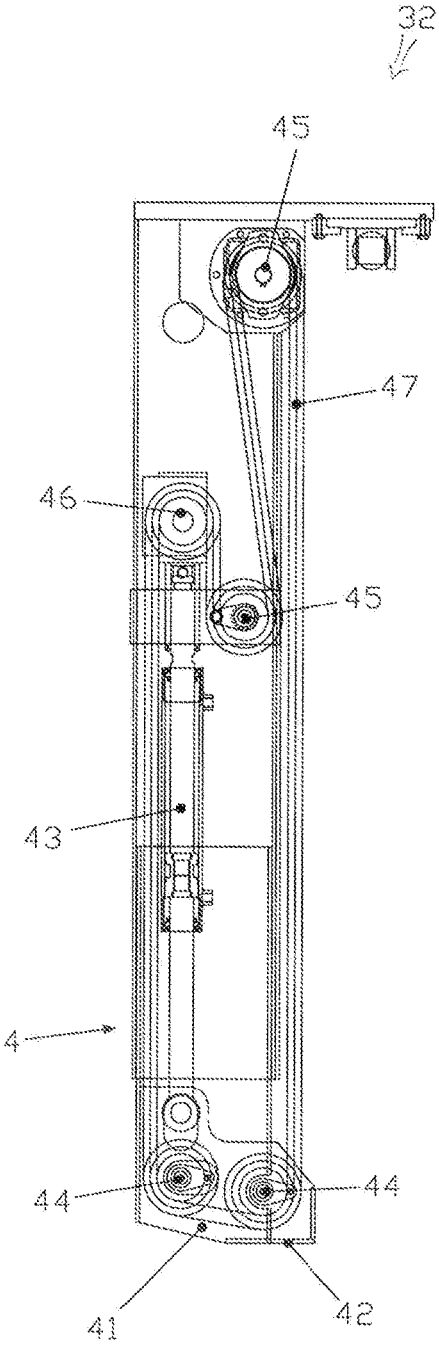

FIG. 5*a* shows a detail of the rear drilling member (3), and in particular it shows the guide (32) of the drilling head (31) and the sliding means (4) suited to cause a supporting foot (41) to be extracted in order to stabilize the rear drilling member (3) on the ground (B).

Figure 5B:
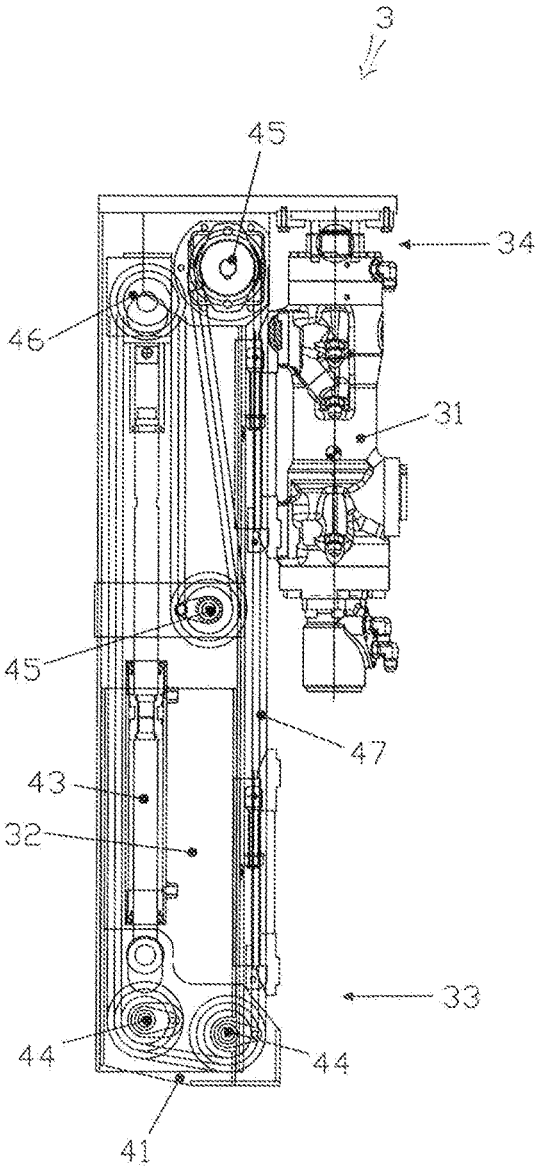

FIG. 5*b* shows also the rear drilling head (31) mounted on the corresponding guide (32).

The invention is a new drilling and/or roof bolting machine (1) particularly suited to operate underground, in mines or tunnels, said machine having a reduced and compact size.

In an excavation site, for example, it is possible to identify the ground (B) on which the machine advances (1), an upper drilling surface or ceiling (C) and/or a lateral drilling surface (A) with respect to the direction of advance (Y) of the machine (1).

The new machine (1) comprises a self-propelled motor vehicle (11), in turn comprising a frame (12) provided with advancing means such as wheels or preferably tracks (13), and in particular at least one pair of tracks (13) positioned side by side.

Said vehicle (11) has a reduced and compact size.

A generic advance direction of the machine (1) is indicated by the arrow (Y) in the drawings.

The new machine (1) comprises at least one front drilling member (2) mounted on the front portion (14) of the vehicle (11) with respect to the advance direction (Y).

Said front drilling member (2) in turn comprises at least one drilling head (21) translating on a corresponding guide (22) between a start position (23) and an end-of-stroke position (24).

Said guide (22) is directly or indirectly constrained to at least one arm (25), in turn directly or indirectly constrained to said front portion (14) of said vehicle (11).

In the preferred solution, said arm (25) is constrained to said front portion (14) of said vehicle (11) through a first bearing ring (26) having horizontal rotation axis (Y), meaning substantially parallel to the direction of advance (Y) of the machine (1), and through a first hinge (27) whose rotation axis (X1) is orthogonal to said rotation axis (Y) of said first bearing ring (26).

Said arm (25) thus has variable inclination with respect to the vehicle (11) and can be rotated with respect to said axis (Y) of said first bearing ring (26).

Said guide (22) is constrained to said arm (25) through a second hinge (28) whose rotation axis (X2) is parallel to that of said first hinge (X1) and through a second bearing ring (29) whose rotation axis (Z1) is orthogonal to the axis of said second hinge (28).

Said guide (22) can thus be lifted and lowered and also rotated in all directions, which results in a corresponding rotation of the drilling direction of said front drilling head (21).

Figure 1:
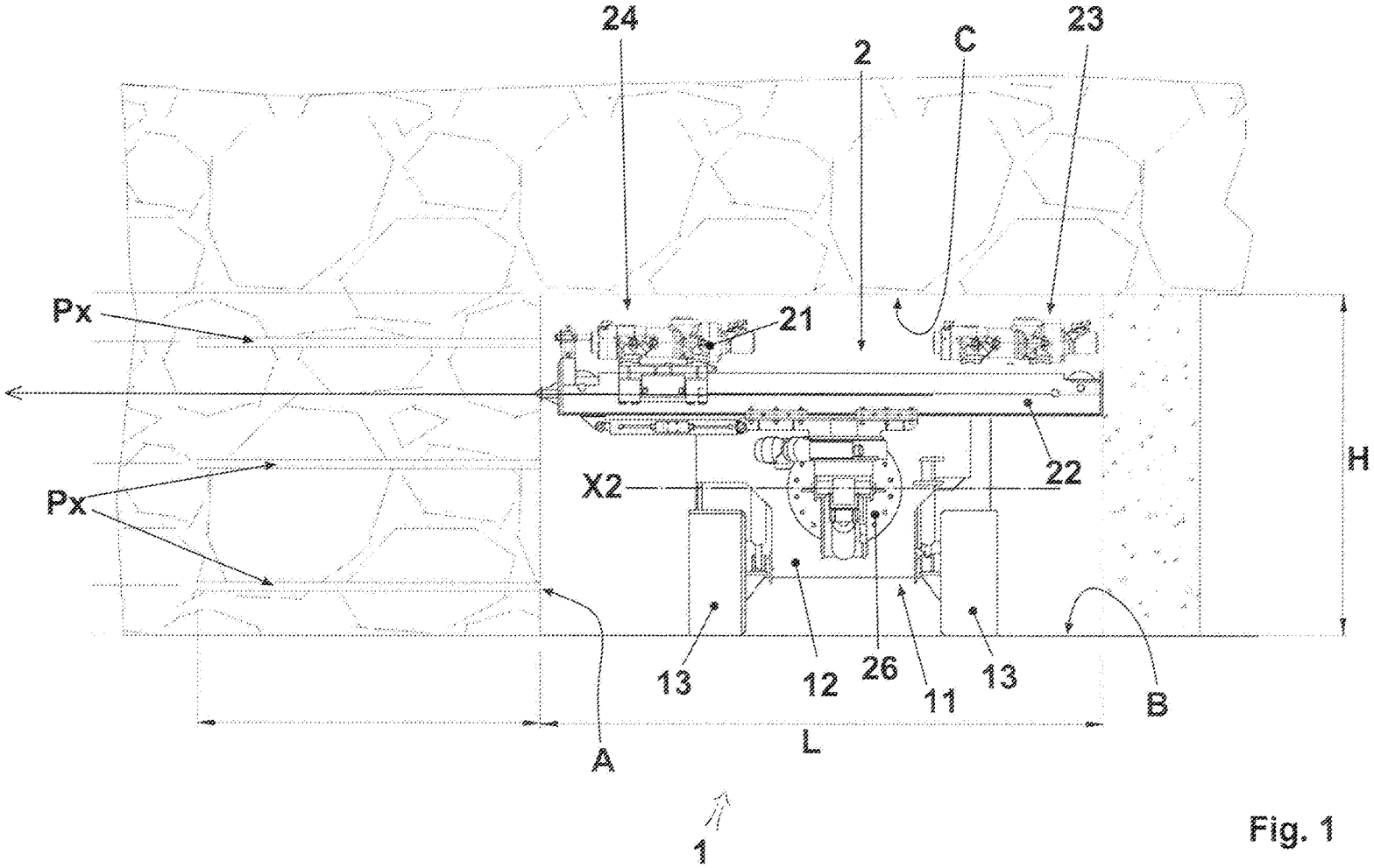
FIG. 1 shows a front view of the new machine (1), in which it is possible to observe the front drilling member (2) oriented in the horizontal direction (X) that is orthogonal to the advance direction (Y) of the machine (1).
Figure 2:
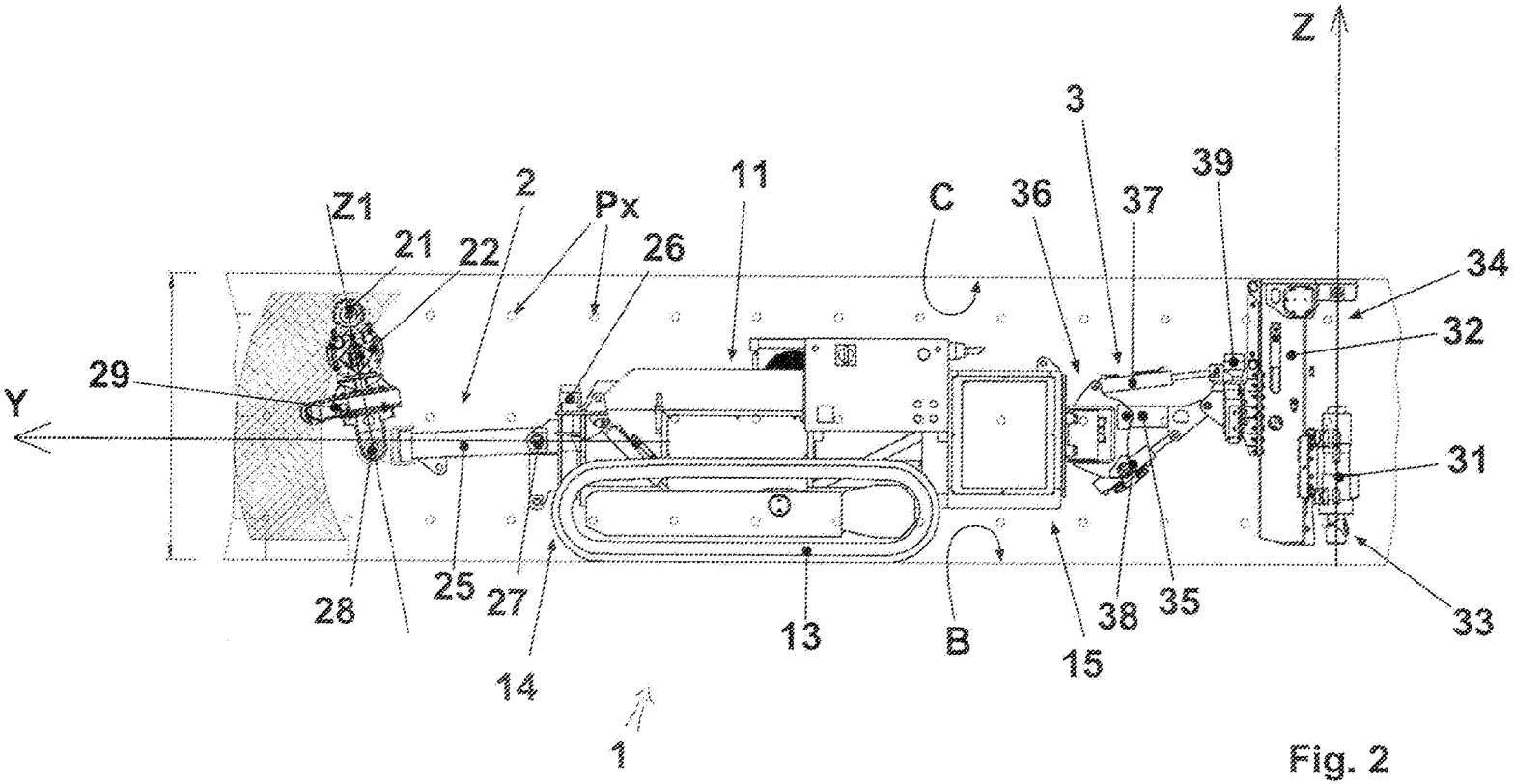
FIG. 2 shows a side view of the new machine (1), in which it is possible to observe the front drilling member (2), oriented as shown in FIG. 1, and the rear drilling member (3), oriented in the vertical direction (Z).
Figure 3:
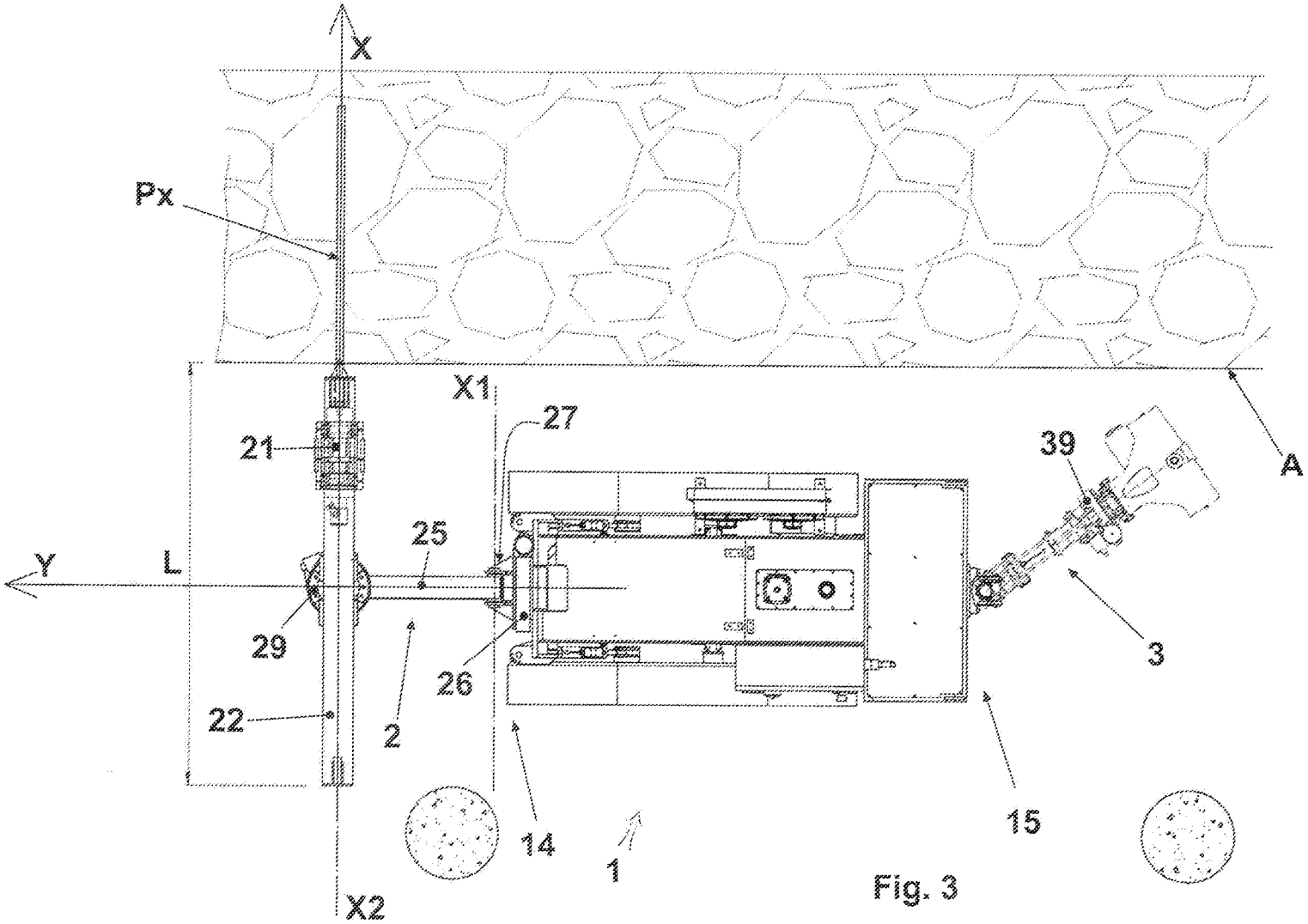
FIG. 3 shows a top view of the new machine (1), in which it is possible to observe the front drilling member (2), oriented as shown in FIG. 1, and the rear drilling member (3), oriented in the vertical direction (Z) and translated laterally with respect to the machine (1), towards a lateral drilling surface (A).

As shown, for example, in FIGS. 1, 2, 3, said front drilling head (21) can perform substantially horizontal drilling operations (Px) on a drilling surface (A) that is located beside the machine (1).

In the rest position, said guide (22) of the front drilling head (21) is arranged horizontally, in a direction that is preferably parallel (Y) to the direction of advance (Y) of the machine (1).

The new machine (1) comprises also at least one rear drilling member (3) mounted on the rear portion (15) of the vehicle (11) with respect to the advance direction (Y).

Said rear drilling member (3) in turn comprises a drilling head (31) translating on a corresponding guide (32) between a start position (33) and an end-of-stroke position (34).

Said head (31) is slidingly and directly or indirectly constrained to said guide (32) through at least one driving chain or belt (47) suited to cause said head (31) to translate, said chain (47) being wound and kept tensioned by means of one or more pulleys (44, 45, 46).

Said guide (32) is directly or indirectly constrained to at least one arm (35), in turn directly or indirectly constrained to said rear portion (15) of said vehicle (11).

Figure 4:
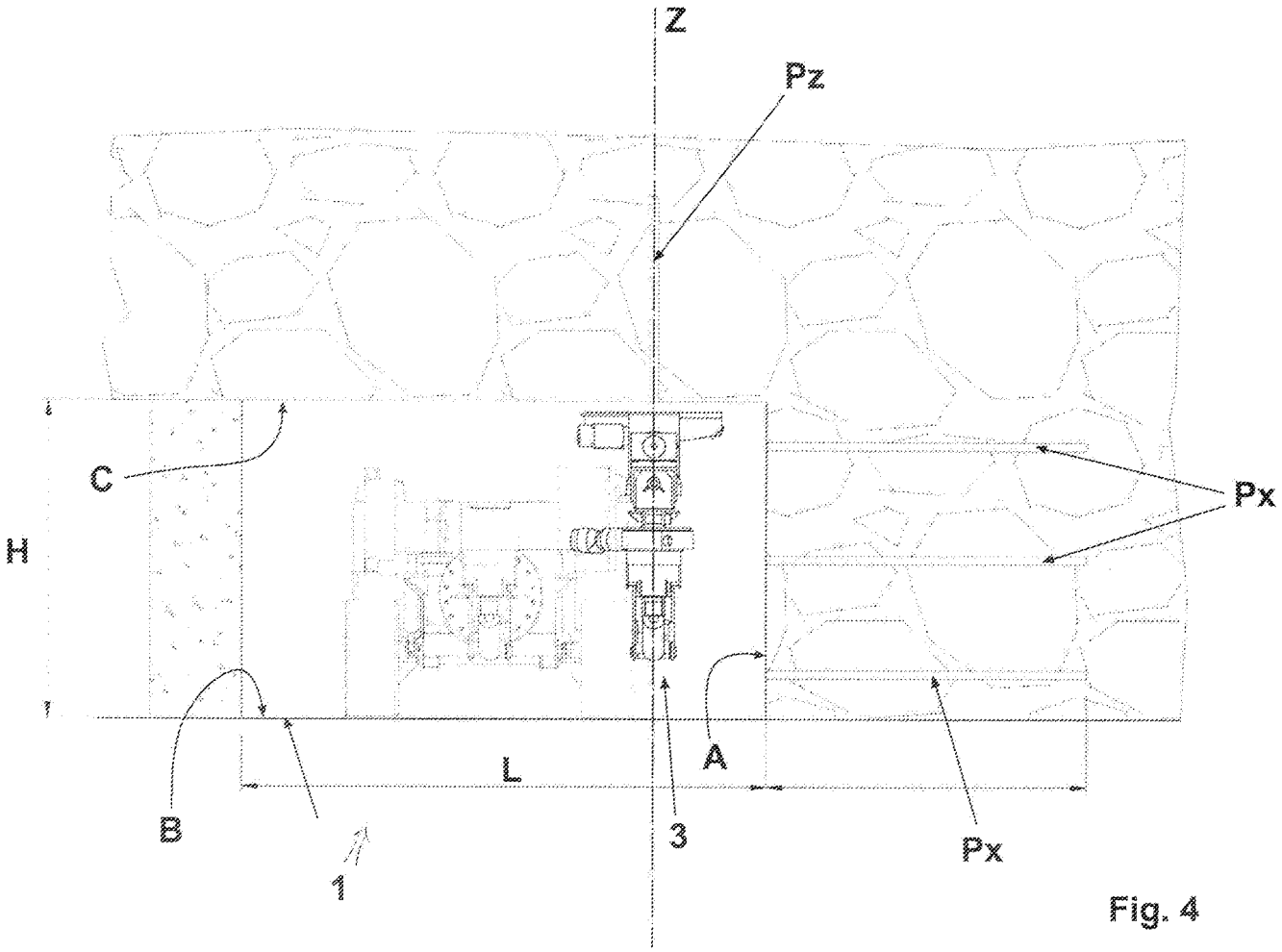
FIG. 4 shows a rear view of the new machine (1), in which it is possible to observe the rear drilling member (3), oriented as shown in FIG. 3.

In the preferred solution, said guide (32) of the rear drilling head (31) can be oriented according to the vertical direction (Z), in such a way that said rear drilling head (31) can perform vertical drilling operations (Pz) directed upwards in the ceiling (C) of the excavation site, as schematically shown in FIG. 4.

Said arm (35) is constrained to said rear portion of the vehicle (11) through at least one first hinge (36) with vertical axis (Z2) that allows said rear drilling head (31) to be shifted laterally, towards the right or towards the left, with respect to the machine (1).

Furthermore, said arm (35) can be articulated and is connected to hydraulic or pneumatic means (37, 38) suited to allow said guide (32) and the drilling head (31) to be lifted and lowered vertically (Z), even until placing it directly or indirectly in contact with the ground (B), that is, until it is at the maximum distance from the drilling surface of the ceiling (C) of the tunnel.

Said guide (32) is preferably constrained to said arm (35) through at least one bearing ring (39) suited to rotate on a vertical plane, in such a way as to vary the inclination of said rear drilling head (31), preferably rotating it by an angle of at least ±180° with respect to the vertical direction (Z).

As shown in FIG. 5, said guide (32) comprises a movable portion or foot (41) suited to translate downwards in a direction that is parallel to said guide (32), that is, towards the ground (B), and then to rest on the ground (B) itself, in order to stabilize the rear drilling member (3) during the drilling operations performed in the ceiling (C) of the tunnel or excavation site in general.

Said supporting foot (41), in particular, is suited to translate with respect to said guide (32) between a rest position and a position in which it is extracted from said guide (32) with a downward movement, as shown in FIG. 5*a*, and comprises in particular a supporting plate (42) suited to be directly rested on the ground (B) when said foot (41) is in said extracted position.

Said translation of said supporting foot (41) is controlled by an actuator (43) acting on said foot (41).

Said foot (41) is furthermore provided with one or more pulleys (44), on which said sliding chain (35) of said head (31) is wound and kept tensioned, said chain (35) being also wound on one or more further pulleys (45) mounted on said guide (32) and on at least one pulley (46) that translates integrally with said actuator (43) of said foot (41).

Furthermore, the extraction of the foot (41) allows the further downward translation of the drilling head (31) down to the lowest possible position, that is, down to said start position (33) at the lower end of said guide (32).

Said position can be reached thanks to the fact that some of said pulleys (44) driving said head (31) are mounted exactly on said foot (41), so that the downward translation of said foot (41) leaves free space on the guide (32), thus allowing said head (31) to be further translated downwards.

The new machine (1) is especially shaped in such a way as to reduce its overall dimensions to a minimum, and thus it can be used also in excavation sites with reduced height and width.

In particular, the minimum excavation width is a function of the length of said guides (22, 32) of the drilling members (2, 3).

In the preferred solution, the overall length of said guide (23) of said front member (2) is approximately 2000-2500 mm, while the overall length of said guide (32) of said rear member (3) is approximately 1000-1500 mm.

Therefore, the new machine (1), even in excavation sites with a height of 1400 mm, for example, can perform vertical or inclined drilling operations (Pz) in the ceiling (C), while in sites that are 2300 mm wide, for example, it can perform horizontal or inclined drilling operations (Px) on drilling surfaces (A) that are located beside the machine (1) or in front of the machine (1).

Therefore, with reference to the above description and the attached drawings, the following claims are expressed.

The invention claimed is:

1. A drilling machine (1), particularly suited to carry out drilling or roof bolting operations in underground excavation sites, tunnels or mines, comprising:

a self-propelled motor vehicle (11);

at least one front drilling member (2) mounted on a front part of the motor vehicle (11) with respect to an advance direction (Y); and at least one rear drilling member (3) mounted on a rear part of the vehicle (11) with respect to the advance direction (Y), wherein at least one of said front or rear drilling members comprises at least one drilling head (21, 31) adapted to be oriented in any direction with respect to the advance direction (Y) of the drilling machine (1), wherein at least one of said front or rear drilling members comprises an integrated sliding system (4) adapted to stabilize the at least one of said front or rear drilling members (2, 3) on a ground (B), wherein said rear drilling member (3) comprises:

the at least one drilling head (31) translating on a corresponding guide (32) between at least two positions, which include a start position (33) and an end-of-stroke position (34);

said guide (32) being directly or indirectly constrained to at least one arm (35); and said arm (35) being directly or indirectly constrained to said vehicle (11) through a constraining device (36, 37, 38) adapted to vary an inclination of said arm (35) both horizontally and vertically with respect to the machine, so as to translate said guide (32) on both a horizontal and a vertical plane, wherein, in a rest position and in an operating position, said guide (32) of the drilling head (31) of the rear member (3) is maintained in a substantially vertical position (Z), wherein said sliding system (4) is mounted on said guide (32) of said rear member (3) and comprises a movable portion or foot (41), and an actuator (43) translating said foot (41) in a direction parallel to said guide (32), between a rest position and a position of downward extraction from said guide (32) towards the ground (B), wherein said foot (41) rests on the ground (B) to stabilize the rear drilling member (3) during perforation of a ceiling (C) of a tunnel or excavation site in general, and wherein said drilling head of said rear member (3) is slidingly and directly or indirectly constrained to said guide (32) through at least one driving belt or chain (35) that is kept tensioned and wound on one or more first pulleys (44) mounted on said foot (41), one or more second pulleys (45) mounted on said guide (32), and at least one third pulley (46) that translates integrally with said actuator (43) of said foot (41).

2. The drilling machine (1) according to claim 1, wherein said sliding system (4) is adapted to stabilize on the ground (B) said at least one of said front or rear drilling members (3) arranged with the drilling head (31) in a substantially vertical direction (Z) and facing upwards, during perforation (Pz) of a ceiling (C) of an excavation or tunnel in a substantially vertical direction.

3. The drilling machine (1) according to claim 1, wherein said front drilling member (2) comprises:

the at least one drilling head (21) translating on a corresponding guide (22) between two positions, which include a start position (23) and an end-of-stroke position (24);

said guide (22) of the at least one drilling head (21) being directly or indirectly constrained to at least one arm (25);

said arm (25) being directly or indirectly constrained to said vehicle (11);

a first constraining device (26, 27) adapted to constrain said arm (25) to said vehicle (11), and to allow rotation of said arm (25) around at least two axes (Y, X1) orthogonal to each other; and a second constraining device (28, 29) adapted to constrain said guide (22) of the drilling head (21) to said arm (25), and to allow the rotation of said guide (22) around at least two axes (X2, Z1) orthogonal to each other, wherein, in a rest position, said guide (22) of the drilling head (21) is arranged horizontally, in a direction parallel (Y) or orthogonal (X) to the advance direction (Y) of the machine (1), while in an operating position, said guide (2) can be arranged in any direction with respect to said advance direction (Y).

4. The drilling machine (1) according to claim 3, wherein said arm (25) of said front drilling member (2) is constrained to said front part (14) of said vehicle (11) through the first constraining device which includes a first bearing ring (26) having a horizontal rotation axis (Y) substantially parallel to the advance direction (Y) of the machine (1), and which further includes a first hinge (27) whose rotation axis (X1) is orthogonal to said rotation axis (Y) of said first bearing ring (26), and wherein said guide (22) is constrained to said arm (25) through a second hinge (28) whose rotation axis (X2) is parallel to said first hinge (X1) and through a second bearing ring (29) whose rotation axis (Z1) is orthogonal to the rotational axis of said second hinge (28).

5. The drilling machine (1) according to claim 1, wherein said guide (32) of said drilling head (31) is constrained to said arm through at least one bearing ring (39) adapted to rotate on a substantially vertical plane, so as to correspondingly vary an inclination of said drilling head (31).

6. The drilling machine (1) according to claim 1, wherein said constraining device (36, 37, 38) of said arm (35) of said rear drilling member (3) translates said guide (32) of said rear member (3) vertically, until placing said rear member directly or indirectly in contact with the ground (B), at a maximum distance from a drilling surface on a ceiling (C) of a tunnel.

7. The drilling machine (1) according to claim 1, wherein said self-propelled motor vehicle (11) comprises a frame (12) provided with at least one pair of tracks (13) positioned side by side.

* * * * *